United States Patent [19]

Nudds

[11] 4,134,111

[45] Jan. 9, 1979

[54] AEROSOL DETECTOR AND METHOD

[75] Inventor: Derrick A. Nudds, Plymouth, England

[73] Assignee: N.V. Tools Limited, England

[21] Appl. No.: 751,114

[22] Filed: Dec. 16, 1976

[51] Int. Cl.[2] ..... G08B 17/10

[52] U.S. Cl. ..... 340/629

[58] Field of Search ..... 340/227 R, 228.1, 237 S, 340/228 R

[56] References Cited

U.S. PATENT DOCUMENTS

| | | | |
|---|---|---|---|
| 3,618,081 | 11/1971 | Morrow | 340/227 R |
| 3,676,877 | 7/1972 | Kobayashi | 340/227 R |
| 3,797,008 | 3/1974 | Yuasa | 340/227 R |
| 3,949,390 | 4/1976 | Rayl et al. | 340/237 S |

*Primary Examiner*—Glen R. Swann, III

*Attorney, Agent, or Firm*—Basile and Weintraub

[57] ABSTRACT

Method and apparatus for detecting an aerosol, such as smoke, is provided. An electric potential is applied to one of a pair of electrically isolated conductors spaced apart from one another by a gap into which smoke may permeate. No potential is applied to the other conductor to attract charge particles to it. The two conductors define a tapering channel for guiding smoke particles to the gap between the conductors. The potential is high enough to ionize any aerosol particles in the gap. These ionized particles then drift to the second conductor, altering its potential. A high-gain amplifier detects any change in the potential of the second conductor and provides an output to indicate detection of an aerosol.

9 Claims, 2 Drawing Figures

AEROSOL DETECTOR AND METHOD

BACKGROUND OF THE INVENTION

1. Field of the Invention

The present invention relates to a fire alarm system and to a smoke and flame detector for use in a fire alarm system.

2. Description of the Prior Art

Heretofore, two methods have been principally used in the detection of smoke. The first method utilizes a light beam and a photosensitive cell and the other utilizes an ionization source. In the system using a light beam, the beam is directed onto the photocell and should smoke interfere with the transmission of light then the output of the photocell will drop indicating the presence of smoke. In the ionization type detector, a radioactive source is utilized to ionize the particles constituting the smoke. The ionized particles are deflected by an electric field onto electrodes the current through which indicates the presence or absence of smoke.

Both of these systems have disadvantages. The system utilizing a light beam requires accurate alignment of the beam with the photocell. Furthermore, a physical object can interrupt the light path accidentally resulting in a false alarm. Additionally the current consumption of the light is excessive for many applications.

The ionization type detector suffers from the disadvantage that it is known to be affected by external radio fields and furthermore because it includes a radioactive source it presents a danger to health. Even if such danger is not pronounced, the presence of the radioactive source in the ionization type detector makes this detector uninviting to the public. Furthermore, ionization detectors are not sensitive to smoke emitted by burning polystyrene.

SUMMARY OF THE INVENTION

According to one of its aspects, the present invention provides a method of detecting smoke and/or flames which includes applying a potential to one of a pair of electrically isolated conductors spaced from one another by a gap into which smoke may permeate, and monitoring the potential on the other conductor. It is believed that the method of detection of the invention is based on the principle that the potential applied to the first conductor is sufficiently high in itself to ionize particles caused by smoke or flames and when these charges drift onto the other plate the potential of this plate changes. The change in potential is indicative of the presence of chargeable particles and may be detected using a high gain amplifier having as high an input impedance as possible so as to require a minimum of driving current. The principle used in detection differs from that of the ionization type of detector in that no radiation source is present and in that no potential is applied to the other electrode to attract charge particles to it.

A smoke and/or flame detector in accordance with the invention includes a pair of spaced conductors, means for applying to one of the conductors a d.c. potential of sufficient magnitude to ionize particles situated between the conductors, a high input impedance high gain amplifier connected to the other conductor, and means for determining when the output of the said amplifier exceeds a predetermined level.

Preferably, a switching element, such as a thyristor, is connected across supply voltage rails and is operative to become conductive when the output of the amplifier exceeds said predetermined level, whereby when smoke and/or flame is detected the switching element short-circuits the supply rails. Such a construction offers the advantage that the presence or absence of smoke and/or flame may be determined merely by examination of the voltage across the voltage supply rails so that only a two wire connection is required for each detector.

Conveniently, the d.c. potential applied to the first conductor is derived by rectification of the signal on the output winding of a transformer of which the input winding forms part of an oscillatory circuit connected across the voltage supply rails. The output from the transformer is conveniently doubled by means of a voltage doubler circuit prior to application to the first conductor.

Advantageously, the conductors are in the form of a pair of parallel plates, extremities of which are splayed apart to define a tapering channel for guiding smoke particles to the gap between the plates.

In accordance with a further aspect of the invention, there is provided a fire alarm system comprising a plurality of detectors as earlier described connected in parallel with one another between a pair of common voltage supply rails, a termination resistor connected across the said rails and means for monitoring the voltage across the rails and indicating when the said voltage drops below a predetermined value as a result of smoke and/or flames being detected by one or more of the detectors.

Preferably, means are further provided for indicating when the voltage across the supply rails rises above a predetermined value so as to indicate an open circuit in the parallel circuit of the smoke detectors and the termination resistor.

Conveniently, the monitoring means is associated with an audible alarm device such as a bell or a siren issuing an alarm warning when one of the detectors short-circuits the voltage supply rails. If desired, the indication from the monitoring means may be utilized to operate water sprinklers within the zone protected by the smoke detectors.

Where a plurality of zones are monitored, the monitoring circuit may form part of an annunciator having several monitoring circuits each associated with a respective plurality of detectors connected in parallel with one another and with a respective termination resistor and arranged within a respective zone. The annunciator may be arranged within a single unit spaced from the audible alarm device. If desired, means may be provided for silencing the audible alarm device, but preferably, under these conditions, the annunciator comprises an internal audible alarm which remains operative after the external alarms have been silenced.

The annunciator, preferably, is connected both to a mains and to a standby power supply and is fitted with means whereby a warning indication is provided when either the mains or the standby battery supply fails.

If desired, the annunciator may further enclose a unit for automatically dialing the fire brigade and transmitting a pre-recorded message in response to detection of fire in any zone.

BRIEF DESCRIPTION OF THE DRAWINGS

The invention will now be described further, by way of example, with reference to the accompanying drawings, in which.

DESCRIPTION OF THE PREFERRED EMBODIMENT

Figure 1:
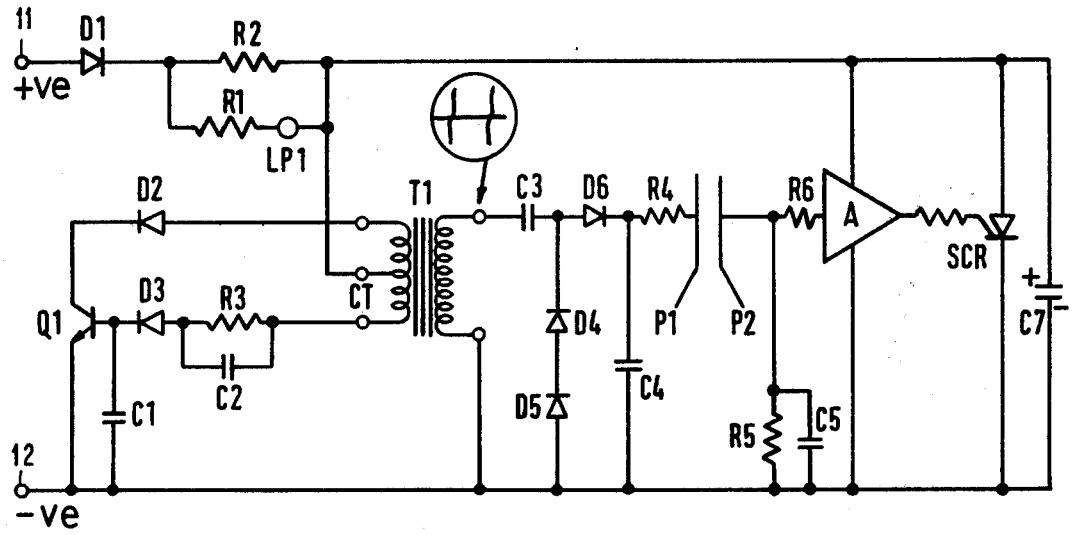
FIG. 1 is a circuit diagram of a smoke detector in accordance with the invention.

In FIG. 1, a smoke detector has positive and negative terminals which serve as voltage supply terminals to the detector and at the same time by monitoring a voltage across the terminals it is possible to determine whether smoke has been detected. The positive terminal is connectable to the positive pole of the d.c. supply and leads to the anode of a diode D1 which serves to protect the circuitry of the detector against connection with reverse polarity. The cathode of the diode D1 is connected to one terminal of a resistor R2 across which there is connected in parallel a resistor R1 and a light-emitting diode LP1. The other end of the resistor R2 is connected to a centre tap of a primary winding of a transformer T1, which winding forms part of a blocking running oscillator further comprised of a diode D2, a resistor R3 in parallel with capacitor C2, a transistor Q1 and capacitor C1. In the absence of smoke or a flame, a quiescent current flow through the resistor R2 to the oscillator, but the voltage drop across the resistor R2 is not sufficient to cause the light emitting diode LP1 to light up.

The oscillatory current in the primary winding of the transformer T1 induces in the secondary winding a voltage of approximately 400 Volts peak to peak in the form of a spike of a few milliseconds duration repeated every 0.5 seconds, the repetition rate being determined by the time constant of R3 and C2. This voltage is doubled by means of a voltage doubler circuit consisting of a capacitor C3, diodes D4 and D5 followed by a diode D6 and a capacitor C4. The d.c. voltage developed across the capacitor C4 is applied to one of a pair of spaced plates P1 and P2 whose lower ends are splayed apart to define a tapering channel for guiding or funnelling smoke into the gap between the plates. Thus the static positive high voltage is stored in C4, but its generation takes only micro amps of average current from the supply.

In the absence of smoke, no voltage appears on the other of the plates but when smoke particles are present in the gap they are ionized by the voltage on the plate P1 and drift onto the plate P2 so as to transfer a positive charge to plate P2.

Plate P2 is held at earth potential via capacitor C5 and resistor R5 (high resistance). Plate P2 is connected via resistor R6 to amplifier A having a high gain and also a very high input impedance. A positive charge on plate P2 as a result of smoke is detected by the amplifier A which triggers thyristor SCR into conduction, so that now a short is placed across the terminals through diode D1, resistor R2 and thyristor SCR. This causes the potential across the terminals 11 and 12 to drop (assuming, of course, that the supply has internal resistance) so that by monitoring the potential across the terminals one may determine whether or not smoke is present. Furthermore, the voltage across resistor R2 now becomes sufficiently high for the light emitting diode LP1 to light up. The thyristor SCR will remain conductive, and no high tension generation will take place until the voltage supply is removed and restored. Under monitoring conditions the total drain current may be of the order of 400 micro amps, and the alarm current of the order of 150 mA.

Figure 2:
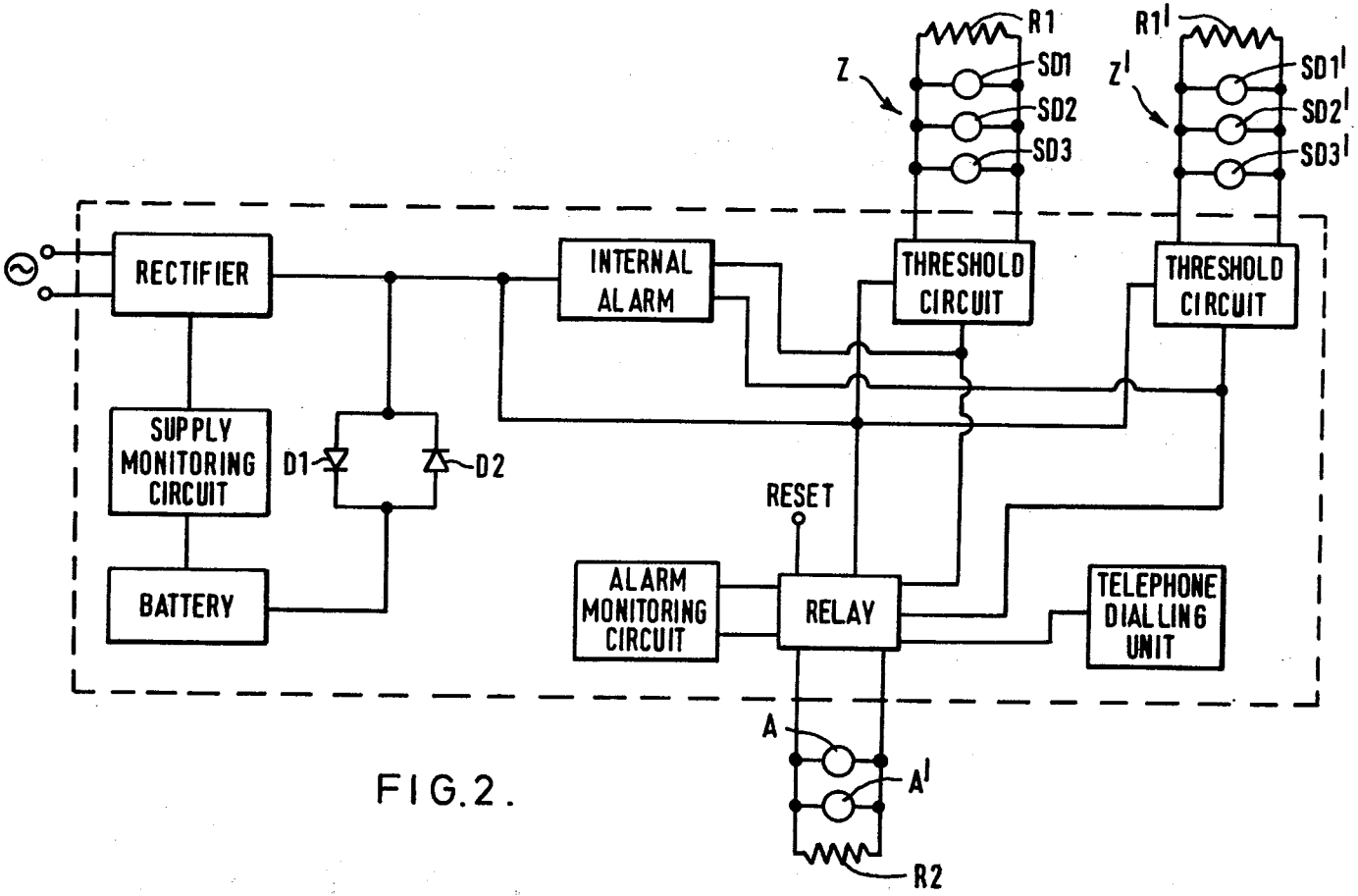
FIG. 2 is a block circuit diagram of a fire alarm system.

In FIG. 2, there is shown an annunciator for supplying voltage to several smoke detectors and also monitoring the voltage across the smoke detectors. The system in FIG. 2 has two sets of smoke detectors Z and Z' which are essentially identical and of which only one will be described. Corresponding circuit elements in the two sets have been allocated in the same reference numerals, the reference numerals of circuit elements in the set Z' having a prime.

Each set is arranged within a different zone and is associated with a respective audible device A, A' which is arranged in the same zone to give off a loud noise when smoke is detected. The smoke detectors SD1, SD2, SD3 within each zone are connected in parallel with one another between two lines connected to a threshold circuit and terminated in a terminal resistor R1. Each threshold circuit is connected to a common power supply line arranged at the output of a mains rectifier. The annunciator also includes a battery connected to the voltage supply line through two diodes D1 and D2 connected in parallel with one another but with reverse polarity, this arrangement being such that the voltage supply to the threshold circuit will be maintained if either the mains or the battery supply should fail though when they are both operative, the mains supply will serve to top up the charge in the standby battery. A supply monitoring circuit is connected to both the mains rectifier and the battery and serves to provide a warning when either should fail. The threshold circuit applies the voltage from the voltage supply across the smoke detectors SD1, SD2 and SD3 and at the same time monitors the voltage across the two output lines. Under normal conditions, each of the detectors takes only a small quiescent current so that the voltage is determined by the terminal resistor R1. In the event of a short-circuit in one of the detectors as a result of smoke, the voltage across the two lines connected across the detectors will drop and this condition is detected by the threshold circuit which is then used to energize a relay having a manual reset and also to energize an alarm arranged internally of the annunciator. The relay, when energized, connects the voltage line to the audible devices A and A' so as to warn personnel in the affected zone. If desired, the relay may be manually reset but an alarm indication will continue to be provided within the annunciator by the internal alarm.

When energized, the relay further applies a voltage supply to a telephone dialing unit which serves to call up the fire brigade by dialing the appropriate number over a public telephone line and transmitting a prerecorded message.

When the relay is reset, the external alarm circuit may be monitored by means of an alarm monitoring circuit which checks for continuity in a circuit consisting of the lines leading to the audible devices A and A' and a terminal resistor R2.

Once smoke has been detected, to reset the internal alarm a switch, not shown, is operated to disconnect the voltage supply from the lines leading to the smoke detectors so that the thyristor 37 within the activated smoke detector can return to its non-conductive state. When the power supply is reconnected, smoke must again be detected for one of the thyristors to be triggered on.

Also included within the annunciator but not shown in the drawing is a circuit similar to the alarm monitoring circuit and serving to test continuity of the circuit consisting of the two supply lines and the terminal resistor R1. In the event of an open circuit in the voltage supply lines, an indication such as a warning light is produced within the annunciator to indicate that a zone is inoperative due to an open circuit.

It will be noted that the described alarm system is fail safe since in addition to generating an alarm when smoke is detected, the system includes monitoring circuits which provide warnings when the system itself includes an abnormal condition. Thus, it ceases to be necessary to use heavy shielded cables for connecting the smoke detectors or the audible devices to the annunciator since a break in the external circuit will itself result in a warning indication being produced.

I claim:

1. A method of detecting aerosols comprising the steps of:

applying a potential to one of a pair of electrically isolated conductors spaced from one another by a gap into which the aerosol may permeate, the potential being sufficiently high to ionize the aerosol, thereby increasing the flow of ions to the second conductor; and sensing the increase in potential at the second of the conductors resulting from the impact of aerosol ions at the second conductor.

2. The method as defined in claim 1 including the step of maintaining the potential on the second conductor at ground potential and wherein the potential of the second conductor is monitored by means of a high gain amplifier having a high input impedance to sense any increase in potential.

3. An aerosol detector comprising:

a pair of spaced conductors;

means for applying a DC potential to one of the conductors of sufficient magnitude to ionize the aerosol between the conductors;

means for maintaining the second conductor at ground potential;

a high gain amplifier having a high input impedance connected to the second of the conductors; and means for determining when the output of said amplifier exceeds a predetermined level.

4. A detector as defined in claim 3 wherein said determining means includes a switching element comprising a thyristor connected across supply voltage rails and is operative to become conductive when the output of the amplifier exceeds said predetermined level whereby when the aerosol is detected, the switching element short circuits the supply rails.

5. The detector as defined in claim 3 wherein the DC potential applied to the first conductor is derived by rectification of the signal on the output winding of a transformer of which the input winding forms a part of an oscillatory circuit connected across the supply rail.

6. The detector as defined in claim 5 wherein the output of the transformer is doubled by means of a voltage doubler circuit prior to the application to the first conductor.

7. The detector as defined in claim 3 wherein the conductors are in the form of a pair of parallel plates, the extremeties of which are splayed apart to define a tapering channel for guiding the aerosol between the plates.

8. The system as defined in claim 3 wherein a first plurality of said predetermined number of detectors is connected in parallel with a second plurality of said predetermined number of detectors, wherein said first plurality of detectors is spaced apart from said second pluraltiy of detectors.

9. An alarm system comprising a predetermined number of interconnected detectors wherein each of the detectors includes a pair of spaced apart conductors, said system comprising:

means for applying to a first conductor of each of said pair of spaced apart conductors a DC potential of sufficient magnitude to ionize an aerosol situated between said spaced apart conductors;

means for maintaining the potential on the second conductor of each pair of said spaced apart conductors at ground potential;

a predetermined number of high gain amplifiers each having a high input impedance connected to a corresponding second conductor and wherein said plurality of detectors is connected in parallel with one another between a pair of common voltage supply rails; and means for determining when the output of any of said amplifiers exceeds a predetermined level as the result of aerosols being detected by one or more of the detectors.

* * * * *